US009527291B2

(12) United States Patent
Shimizu

(10) Patent No.: US 9,527,291 B2
(45) Date of Patent: Dec. 27, 2016

(54) PRINTING APPARATUS

(71) Applicant: SEIKO EPSON CORPORATION, Tokyo (JP)

(72) Inventor: Kazutoshi Shimizu, Shimosuwa-Machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/993,761

(22) Filed: Jan. 12, 2016

(65) Prior Publication Data

US 2016/0236473 A1 Aug. 18, 2016

(30) Foreign Application Priority Data

Feb. 12, 2015 (JP) ..... 2015-025686

(51) Int. Cl.
*B41J 2/165* (2006.01)

(52) U.S. Cl.
CPC ..... *B41J 2/16517* (2013.01)

(58) Field of Classification Search
CPC ..... B01D 47/06; B01D 19/0057; B01D 45/00; B41J 2/175; B41J 2/19; B41J 2/16517; B41J 2/20
USPC ..... 347/34, 89, 90
See application file for complete search history.

(56) References Cited

U.S. PATENT DOCUMENTS 4,361,845 A * 11/1982 Smith ..... B41J 2/20 347/90
6,234,621 B1 * 5/2001 Musser ..... B41J 2/19 347/89
2014/0043414 A1 * 2/2014 Arima ..... B41J 2/19 347/90
2014/0225959 A1 8/2014 Kobayashi et al.

FOREIGN PATENT DOCUMENTS

JP 2014-151642 8/2014

* cited by examiner

*Primary Examiner* — Jannelle M Lebron
(74) *Attorney, Agent, or Firm* — Workman Nydegger

(57) ABSTRACT

A printing apparatus is provided with an ink ejecting section which performs printing by ejecting an ink onto a printing medium and a mist processing device which processes an ink mist which is generated together with an ejection of the ink. The printing apparatus includes a gas-liquid separation section which separates the ink mist into a separated gas and a separated liquid using a centrifugal force generated by an airflow, an airflow generating section which is provided in an exhaust flow path which is joined to an exhaust side of the separated gas in the gas-liquid separation section and generates the airflow, and a liquid leakage detection section, which is provided beneath an exhaust port which is provided on a downstream end of the exhaust flow path, and is capable of detecting a liquid which is released from the exhaust port.

7 Claims, 2 Drawing Sheets

PRINTING APPARATUS

BACKGROUND

1. Technical Field

The present invention relates to a printing apparatus which performs printing by ejecting the functional liquid onto a printing medium is provided with a mist processing device which processes a functional liquid mist which is generated together with the ejection of the functional liquid.

2. Related Art

In the related art, as this type of mist processing device, there is known a mist collection mechanism which subjects an ink mist which is generated together with an ejection of an ink from an ink jet head to a collection process (refer to JP-A-2014-151642). The mist collection mechanism is configured by a mist suction section which is arranged along the ink jet head and suctions an ink mist, and a gas-liquid separation section which subjects the suctioned ink mist to gas-liquid separation.

The gas-liquid separation section is provided with a gas-liquid separation cyclone, a filter unit, a blower, a waste liquid section, and a check valve (substantially an open-close valve). The mist suction section is connected to the inlet side of the gas-liquid separation cyclone, the filter unit is connected to the cyclone muffler of the gas-liquid separation cyclone, the blower is provided in the exhaust flow path which is joined to the exhaust side of the filter unit, the waste liquid section is provided on the bottom portion of the gas-liquid separation cyclone, and the check valve is provided in the waste liquid flow path which is joined to the waste liquid section. The flow path end of the waste liquid flow path is connected to the waste liquid tank.

When the blower is driven, a vortex forms within the gas-liquid separation cyclone and the ink mist which flows in from the mist suction section is subjected to gas-liquid separation. The gas (air), after the gas-liquid separation, passes through the filter unit and the blower, and is exhausted from the exhaust flow path. The liquid (the ink), after the gas-liquid separation, is temporarily reserved in the waste liquid section, and flows into the waste liquid tank due to the check valve being opened (unstopped) during non-printing.

In such a mist collection mechanism of the related art, during the printing, it is necessary to close a check valve (a valve) in order to maintain a vortex of a gas-liquid separation cyclone. Meanwhile, during the non-printing, it is necessary to open the valve in order to discharge the ink which remains in the gas-liquid separation cyclone as waste liquid. Therefore, when the valve breaks and there is an operation fault, various problems are anticipated to occur. For example, when the valve does not open (closing is maintained), the ink in a waste liquid section spills, eventually, the spilled ink is suctioned from a cyclone muffler and is discharged to the outside via an exhaust flow path. The discharged ink influences suction exhaust equipment which is an external device. Meanwhile, when the valve does not close (opening is maintained), air leaks from the waste liquid side, and suction of the ink mist and generation of the vortex are reduced. In other words, the ink mist collection becomes insufficient and the printing quality is influenced.

SUMMARY

An advantage of some aspects of the invention is to provide a printing apparatus capable of easily and reliably detecting a process fault in gas-liquid separation.

According to an aspect of the invention, there is provided a printing apparatus provided with a functional liquid ejecting section which performs printing by ejecting a functional liquid onto a printing medium and a mist processing device which processes a functional liquid mist which is generated together with an ejection of the functional liquid. The printing apparatus includes a gas-liquid separation section which separates the functional liquid mist into a separated gas and a separated liquid using a centrifugal force generated by an airflow, an airflow generating section which is provided in an exhaust flow path which is joined to an exhaust side of the separated gas in the gas-liquid separation section and generates the airflow, and a liquid leakage detection section, which is provided beneath an exhaust port which is provided on a downstream end of the exhaust flow path, and is capable of detecting a liquid which is released from the exhaust port.

In the gas-liquid separation section, when a process fault occurs in the gas-liquid separation as when the separated liquid is sucked up after the separation, when the functional liquid mist flows and condenses on the exhaust side due to the gas-liquid separation being insufficient or the like, liquid (the functional liquid) is discharged together with the separated gas from the exhaust port by the airflow generating section.

In this case, since the liquid which is released from the exhaust port is detected by the liquid leakage detection section which is provided beneath the exhaust port of the exhaust flow path, when a process fault occurs in the gas-liquid separation section, it is possible to easily and reliably detect the process fault.

The printing apparatus preferably further includes a waste liquid valve which is provided in a waste liquid flow path which is joined to a waste liquid side of the separated liquid in the gas-liquid separation section, and a determination section which determines whether or not an operation fault has occurred in the waste liquid valve, in which the determination section preferably determines that an operation fault has occurred in the waste liquid valve when the liquid leakage detection section detects the liquid.

The process fault of the gas-liquid separation section is empirically most likely to be an operation fault of the waste liquid valve. It is thought that the waste liquid valve suffers an operation fault due to erosion of dust which is mixed into the separated liquid or the adhesion of a component of the functional liquid.

In this case, it is possible to swiftly discover the fault location and a countermeasure by determining that the process fault which is detected by the liquid leakage detection section is an operation fault of the waste liquid valve.

The printing apparatus preferably further includes a suction flow path, which includes a suction port section which has an atmosphere-open space at an upstream end portion and faces the exhaust port, and is connected to suction exhaust equipment on a downstream side, in which the suction port section is preferably formed in a shape expanding toward an open end.

In this case, since the suction flow path which is joined to the suction exhaust equipment is configured to have an atmosphere-open space and to face the exhaust port, it is possible to separate the airflow generating section side from the suction exhaust equipment side by pressure, and it is possible to remove the influence of pressure therebetween. Since the suction port section is formed in an expanding shape, it is possible to appropriately suction the separated gas of the airflow generating section at the suction exhaust equipment side in a state in which the airflow generating section side is separated from the suction exhaust equipment side by pressure. Note that, the suction exhaust equipment is so-called factory ventilation equipment or the like of the outside of the apparatus.

In the printing apparatus, the suction flow path preferably extends upward in a state in which the open end of the suction port section faces downward in relation to the liquid leakage detection section.

In this case, even if a portion of the liquid which is released from the exhaust port is unintentionally sucked into the suction port section, the liquid adheres to the suction flow path, naturally flows down, and will not reach the suction exhaust equipment.

The printing apparatus preferably further includes a waste liquid reservoir section which is provided on a downstream end of the waste liquid flow path and reserves the separated liquid, and a drainage pan on which the waste liquid reservoir section is installed, in which the liquid leakage detection section is preferably installed on the drainage pan.

In this case, it is possible to finally receive the liquid which is released from the exhaust port toward the liquid leakage detection section using the drainage pan, and it is possible to easily perform the processing of the liquid which is released. It is possible to use the same components for the drainage pan and the liquid leakage detection section which receive the liquid leakage (overflowing or the like) from the waste liquid reservoir section and the drainage pan and the liquid leakage detection section which receive the liquid which drips from the exhaust port, and it is possible to simplify the equipment. In other words, it is possible to detect the liquid leakage from the waste liquid reservoir section and a process fault of the gas-liquid separation merely by moving the liquid leakage detection section which is originally installed on the drainage pan to a position directly beneath the exhaust port.

Meanwhile, the printing apparatus preferably further includes a stop control section which stops printing when the liquid leakage detection section detects the liquid.

In this case, it is possible to swiftly handle a degradation in print quality based on a processing fault of the gas-liquid separation section.

Similarly, the printing apparatus preferably further includes a notification section which performs notification indicating that a process fault has occurred in the gas-liquid separation when the liquid leakage detection section detects the liquid.

In this case, it is possible to swiftly discover the fault location and to swiftly perform a countermeasure.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of a printing apparatus provided with a mist processing device according to an embodiment of the invention with reference to the accompanying drawings. The printing apparatus is an apparatus which feeds a printing medium which is set therein using a roll-to-roll system and ejects an ultraviolet ray curing ink (hereinafter referred to as "a UV ink") onto the printing medium being fed to perform printing. The mist processing device is attached to the printing apparatus (an apparatus main body) and subjects an ink mist which is generated by the ejection of the UV ink to a gas-liquid separation process. Note that, the UV ink is an example of "a functional liquid".

Figure 1:
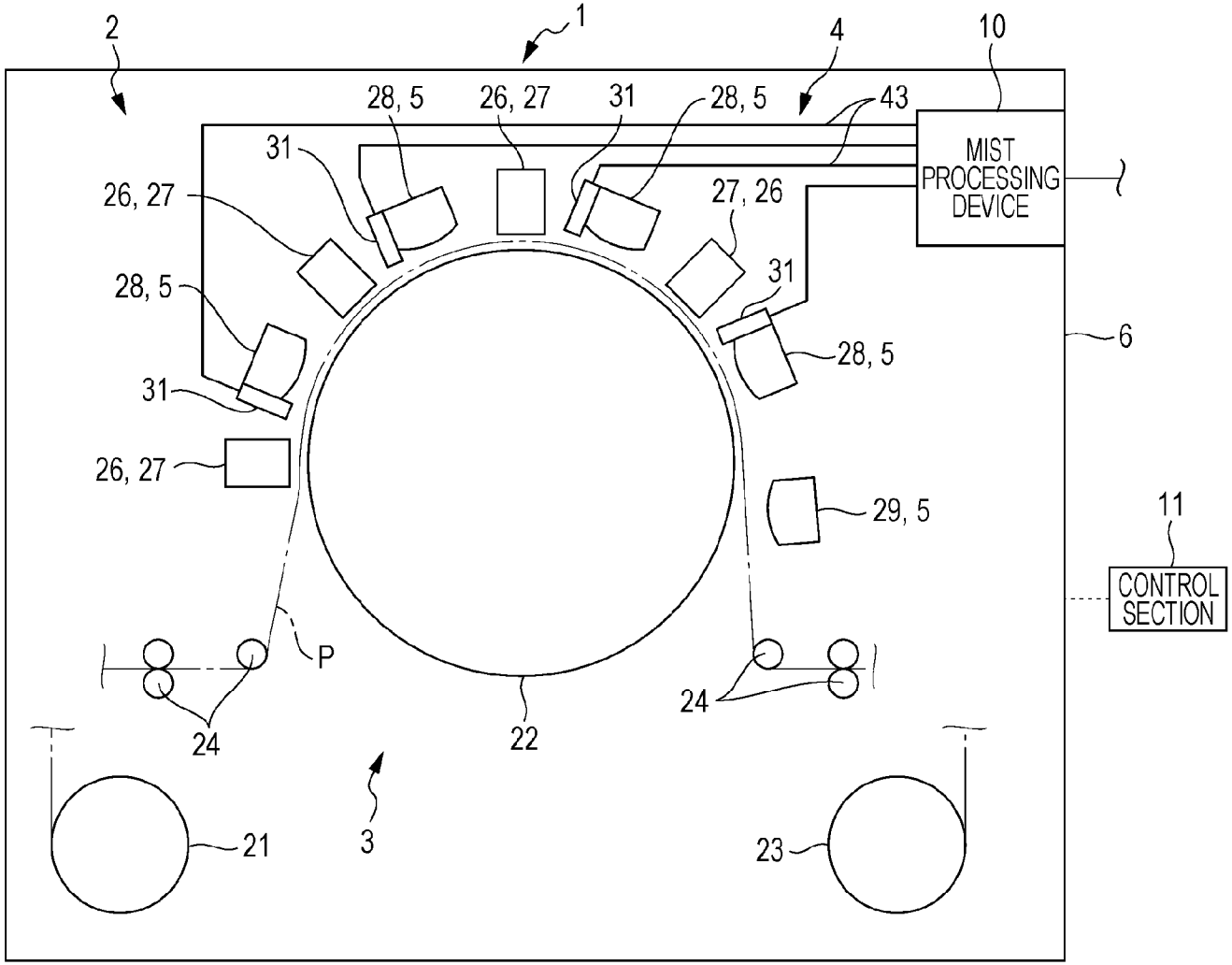
FIG. 1 is an overall schematic diagram of a printing apparatus according to an embodiment.

FIG. 1 is an overall schematic diagram of a printing apparatus according to an embodiment. As illustrated in FIG. 1, the printing apparatus 1 is provided with a medium feed section 3, an ink ejecting section 4, an irradiating section 5, and a safety cover 6. The medium feed section 3 feeds a printing medium P which is continuous paper using a roll-to-roll system, the ink ejecting section 4 ejects (prints) the UV ink onto the printing medium P being fed using an ink jet system, the irradiating section 5 cures the UV ink which is applied to the printing medium P using irradiation of ultraviolet rays, and the safety cover 6 houses these constituent devices. An apparatus main body 2 which forms the main body of the printing apparatus 1 is formed of the medium feed section 3, the ink ejecting section 4, the irradiating section 5, and the like. Note that, the ink ejecting section 4 is an example of "a functional liquid ejecting section".

The printing apparatus 1 is provided with a mist processing device 10 which processes an ink mist of the UV ink which is generated by the ink ejecting section 4. The printing apparatus 1 is provided with a control section 11 which performs the overall control of the constituent devices. Note that, the material of the printing medium P is not particularly limited, and various materials such as paper-based materials and film-based materials may be used. The mist processing device 10 may be provided inside the safety cover 6 as illustrated in FIG. 1, and may be provided on the outside.

The medium feed section 3 is provided with a feed-out reel 21, a rotating drum 22, a winding reel 23, and a plurality of rollers 24. The feed-out reel 21 feeds out the printing medium P which is wound in a roll shape, the rotating drum 22 feeds the fed-out printing medium P while holding the printing medium P for the printing, the winding reel 23 winds the printing medium P which is fed out from the rotating drum 22 in a roll shape, and the plurality of rollers 24 restricts (path change) the feed path of the printing medium P centered on the rotating drum 22.

The printing medium P is held to the outer circumferential surface of the rotating drum 22 and is fed to circulate by the rotation of the rotating drum 22. The ink ejecting section 4 faces the rotating drum 22 in a portion of the outer circumferential surface thereof and ejects (prints) the UV ink onto the printing medium P being fed based on print data. In other words, the rotating drum 22 functions as a platen in relation to the ink ejecting section 4.

The ink ejecting section 4 is provided with a plurality of head units 26. The plurality of head units 26 is provided to line up along the outer circumferential surface of the rotating drum 22. The plurality of head units 26 correspond, one-for-one, with a plurality of types of the UV ink (for example, the four colors C, M, Y, and K). Each of the head units 26 is provided with a plurality of ink jet heads 27 (refer to FIG. 2) in order to form a single printing line in the axial direction of the rotating drum 22. The plurality of ink jet heads 27 of each of the head units 26 selectively ejects the UV ink onto the printing medium P which is supported on the outer circumferential surface of the rotating drum 22. Accordingly, a color image is formed on the printing medium P.

The irradiating section 5 is provided with a plurality of temporary curing irradiators 28 and a real curing irradiator 29. The plurality of temporary curing irradiators 28 correspond to the plurality of head units 26, and the real curing irradiator 29 is provided between the rotating drum 22 and the winding reel 23 such that the feed path passes therethrough. The plurality of temporary curing irradiators 28 is provided to line up along the outer circumferential surface of the rotating drum 22 alternately with the plurality of head units 26, one-to-one.

In this case, the temporary curing irradiators 28 are arranged on the downstream side in the feeding direction of the printing medium P in relation to the corresponding head units 26. Although detailed description will be given later, mist collection ports 41 which suction the ink mist are arranged between the temporary curing irradiators 28 and the head units 26. When the UV ink is ejected onto the printing medium P, the generated ink mist is suctioned and, directly after landing on the printing medium P, the UV ink is irradiated with ultraviolet rays, and the curing is performed. Accordingly, dirtying of the printing medium P by the ink mist is suppressed, and spreading of the dots of the UV ink and mixing of the colors are suppressed.

The real curing irradiator 29 is arranged closer to the downstream side than the temporary curing irradiator 28 which is provided closest to the downstream side in the feed path. The real curing irradiator 29 irradiates the printing medium P which is subjected to the ejection of the UV inks and the temporary curing with ultraviolet rays of a greater integral light quantity than the temporary curing irradiators 28. Accordingly, the UV ink which lands on the printing medium P is completely cured and is fixed to the printing medium P. Note that, it is possible to use, for example, a light emitting diode (LED) lamp, a high pressure mercury lamp, or the like which radiates ultraviolet rays in the temporary curing irradiators 28 and the real curing irradiator 29.

Figure 2:
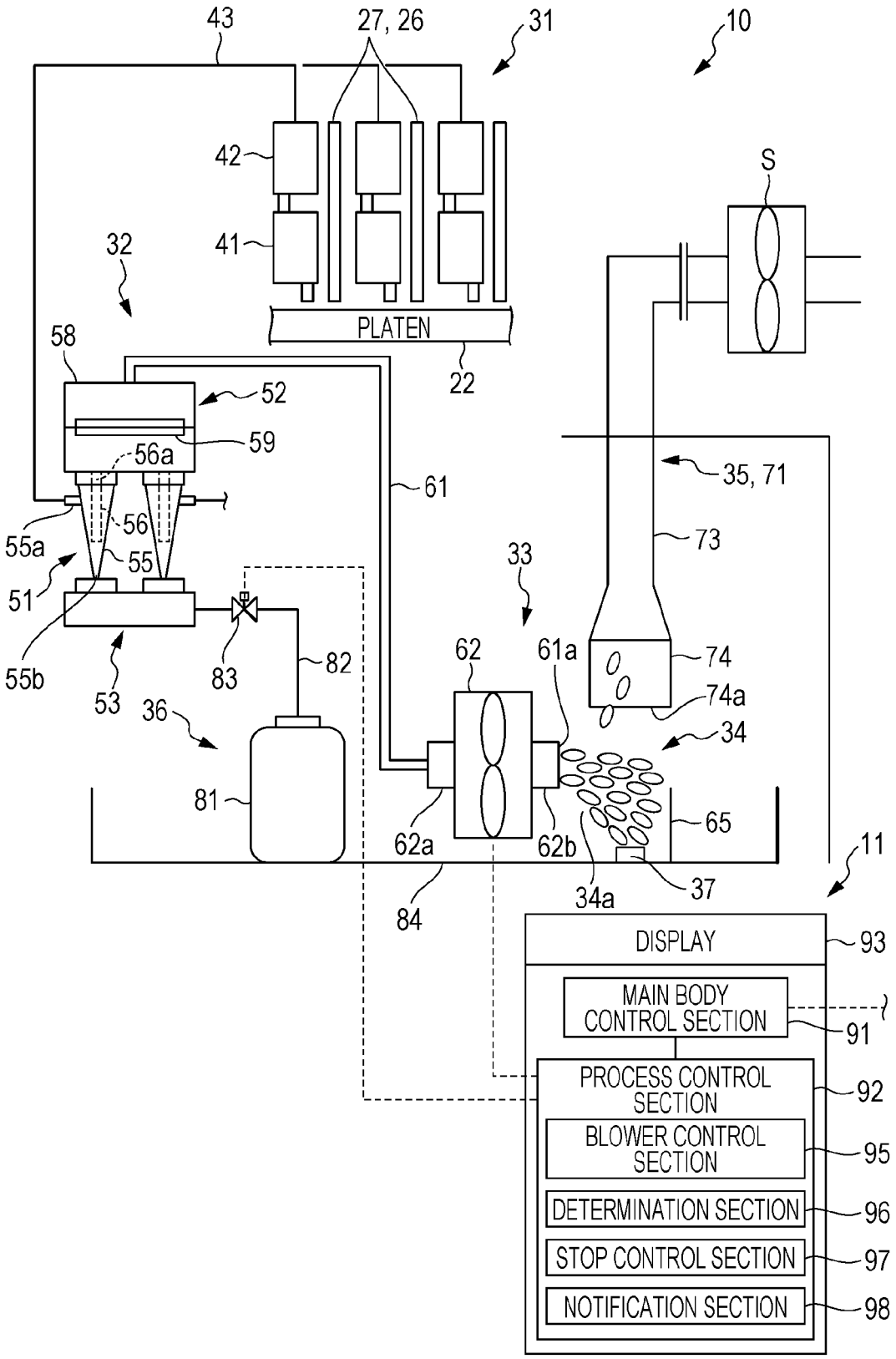
FIG. 2 is a system configuration diagram of a mist processing device according to the embodiment.

Next, description will be given of the mist processing device 10 with reference to the system configuration diagram of FIG. 2. As illustrated in FIG. 2, the mist processing device 10 is provided with a plurality of mist collection sections 31, a gas-liquid separation section 32, and an airflow generating section 33. The mist collection sections 31 are provided to correspond to each of the head units 26 for separate ink colors, the gas-liquid separation section 32 subjects the ink mist (a functional liquid mist) which is collected by the plurality of mist collection sections 31 to gas-liquid separation, and the airflow generating section 33 generates an airflow for the gas-liquid separation in the gas-liquid separation section 32 and discharges the separated gas (air). The mist processing device 10 is provided with a gas suction section 35 and a waste liquid collection section 36. The gas suction section 35 guides the separated gas which is exhausted from the airflow generating section 33 to suction exhaust equipment S via an atmosphere-open section 34, and the waste liquid collection section 36 collects the separated liquid (the ink) which is separated by the gas-liquid separation section 32.

The mist processing device 10 is provided with a liquid leakage detection section 37 which is positioned in the atmosphere-open section 34 and detects liquid which is generated by a process fault in the gas-liquid separation. The liquid leakage detection section 37, the airflow generating section 33 and the waste liquid collection section 36 are each connected to the control section 11. Although detailed description will be given later, while the control section 11 drives a blower 62 of the airflow generating section 33 during the driving of the medium feed section 3, the ink ejecting section 4, and the irradiating section 5 which form the apparatus main body 2 of the printing apparatus 1, the control section 11 opens (unstops) a waste liquid valve 83 of the waste liquid collection section 36 during the non-driving of these constituent devices. The control section 11 monitors whether or not an operation fault has occurred in the waste liquid valve 83 via the liquid leakage detection section 37.

Each of the mist collection sections 31 includes the mist collection port 41, a collection chamber 42 (a pressure chamber), and a collection flow path 43. The mist collection ports 41 are provided in a line shape corresponding to the head units 26 for separate ink colors, the mist collection ports 41 are connected to the collection chambers 42, and the collection flow paths 43 connect the collection chambers 42 to the gas-liquid separation section 32 and are provided for separate ink colors. In this case, a heat sink of the temporary curing irradiator 28 is arranged inside the mist collection port 41, and the mist collection port 41 also functions as a cooling section which cools the heat sink of the temporary curing irradiator 28 using the airflow which is generated by the blower 62. When the airflow generating section 33 is driven, a suction force acts on the plurality of mist collection sections 31 via the gas-liquid separation section 32. The suction force (a negative pressure) which acts on each of the mist collection sections 31 acts uniformly in the direction in which the mist collection ports 41 extend via the collection chambers 42. Accordingly, the ink mist which is generated by each of the head units 26 is suctioned appropriately in a uniform manner. Note that, the collection flow path 43 is formed of a chemical resistant resin tube or the like.

The gas-liquid separation section 32 includes a plurality of cyclones 51, a filtering section 52, and a waste liquid reservoir section 53. The plurality of collection flow paths 43 provided for separate ink colors are connected to the plurality of cyclones 51, the filtering section 52 is joined to the exhaust side of the plurality of cyclones 51, and the waste liquid reservoir section 53 is joined to the waste liquid side of the plurality of cyclones 51. The cyclone 51 includes a cyclone main body 55 and a cyclone muffler 56. The cyclone main body 55 is formed in a funnel shape, and the cyclone muffler 56 is provided inside the cyclone main body 55.

A collection inlet 55*a* which extends in a direction which is tangential to the cyclone main body 55 is formed in the top end portion of the cyclone main body 55, and the downstream end portion of the corresponding collection flow path 43 is connected to the collection inlet 55*a*. A waste liquid outlet 55*b* which is joined to the waste liquid reservoir section 53 is formed in the bottom end portion of the cyclone main body 55, and the separated liquid (the UV ink) which is subjected to gas-liquid separation in the cyclone main body 55 flows down into the waste liquid reservoir section 53 via the waste liquid outlet 55*b*. The cyclone muffler 56 is arranged on the same axis as the cyclone main body 55, and the bottom end portion of the cyclone muffler 56 is open to the bottom portion of the cyclone main body 55. An exhaust outlet 56*a* which is joined to the filtering section 52 is formed in the base portion of the cyclone muffler 56, and the separated gas (air) which is subjected to gas-liquid separation in the cyclone main body 55 is guided to the filtering section 52 via the exhaust outlet 56*a*.

When the airflow generating section 33 is driven, a suction force acts within the cyclone main body 55 via the cyclone muffler 56, and a vortex forms within the funnel-shaped cyclone main body 55. In other words, the ink mist which flows into the cyclone main body 55 via the collection inlet 55*a* forms a vortex along the inner circumferential surface of the cyclone main body 55 and is gradually guided downward. At this time, a strong centrifugal force acts on the ink mist and the ink mist is separated into a separated liquid (the UV ink) and a separated gas (air). The separated liquid flows along the inner circumferential surface of the cyclone main body 55 and down into the waste liquid reservoir section 53, and the separated gas is guided to the filtering section 52 through the cyclone muffler 56.

The waste liquid reservoir section 53 receives the separated liquid from the plurality of cyclones 51 in one batch, and temporarily reserves the received liquid. Therefore, the waste liquid reservoir section 53 is positioned directly beneath the plurality of cyclones 51 and is formed of a thin, sealed tank. The volume of the waste liquid reservoir section 53 is rendered capable of reserving, for example, one day worth of separated liquid in consideration of the driving time of the printing apparatus 1 (the apparatus main body 2).

The filtering section 52 includes a sealed-system filter case 58 and a filter 59 which is embedded in the filter case 58. The filter case 58 is connected by the bottom surface thereof to the plurality of cyclones 51 and also functions as a chamber (a pressure chamber) in order to cause a uniform negative pressure (suction force) to act on the plurality of cyclones 51. The filter 59 removes dust such as paper dust which is mixed into the separated gas and captures the ink mist which may not be completely separated by the gas-liquid separation. Note that, it is preferable that a pressure sensor is provided within the filter case 58, and that the clogging status of the filter 59 is monitored by the control section 11 described above.

The airflow generating section 33 includes an exhaust flow path 61 and the blower 62. The upstream end portion of the exhaust flow path 61 is connected to a secondary side (the downstream side) of the filtering section 52, and the blower 62 is a high pressure blower which is provided such that the exhaust flow path 61 passes therethrough. The exhaust flow path 61 is formed of a flexible duct made from aluminum, for example. The blower 62 is formed of a turbo-blower or the like, and is installed with an intake port 62*a* on the upstream side and an ejection port 62*b* on the downstream side. Accordingly, the blower 62 causes the suction force (the negative pressure) to act on the gas-liquid separation section 32 and the mist collection section 31 via the exhaust flow path 61, suctions the ink mist, and generates the airflow (the vortex) for subjecting the ink mist to gas-liquid separation. The control section 11 drives the blower 62 in synchronization with the print driving of the apparatus main body 2 (detailed description will be given later).

An exhaust port 61*a* is formed on the downstream end of the exhaust flow path 61, and the exhaust port 61*a* is open to an atmosphere-open space 34*a* which is formed in the atmosphere-open section 34. In the atmosphere-open section 34, the exhaust port 61*a* faces an open end 74*a* (described later) which forms the upstream end of the gas suction section 35. The atmosphere-open section 34 (an atmosphere-open space 34*a*) separates the airflow generating section 33 side from the gas suction section 35 side by pressure, and the negative pressure (suction pressure) of the suction exhaust equipment S described above does not influence the blowing capability of the airflow generating section 33. Note that, as illustrated in FIG. 2, the ejection port 62*b* of the blower 62 may be configured to also serve as the exhaust port 61*a*.

The atmosphere-open section 34 is formed between the exhaust port 61*a* (the ejection port 62*b* of the blower 62 depicted in FIG. 2) which is arranged to face horizontally with a gap above a drainage pan 84 (described later), and the open end 74*a* (the upstream end) of the gas suction section 35 which faces downward. The liquid leakage detection section 37 is arranged in the atmosphere-open section 34. The liquid leakage detection section 37 is formed of a so-called liquid leakage sensor and is arranged on the drainage pan 84 beneath the exhaust port 61*a*. In other words, in order to detect the liquid which is released from the exhaust port 61*a*, the liquid leakage detection section 37 is installed at the landing position of the liquid which is released from the exhaust port 61*a*. Although detailed description will be given later, the liquid leakage detection section 37 is connected to the control section 11, and the control section 11 monitors the operation faults of the waste liquid valve 83 and the liquid leakage of a waste liquid tank 81 which are described later based on the detection results of the liquid leakage detection section 37.

A partitioning plate 65 which faces the exhaust port 61*a* to interpose the liquid leakage detection section 37 therebetween and partitions a portion of the atmosphere-open section 34 (the atmosphere-open space 34*a*) is provided on the drainage pan 84.

The partitioning plate 65 is formed in an arc shape as viewed from above to match the open end 74*a* of the gas suction section 35. The separated gas (air) which is exhausted from the exhaust port 61*a* is blown out to the atmosphere-open section 34 toward the partitioning plate 65 and subsequently suctioned upward by the gas suction section 35.

The gas suction section 35 is formed of a suction flow path 71 which is joined to the suction exhaust equipment S of the outside of the apparatus. The suction flow path 71 includes a suction in-duct 73 and a reducer 74 (suction port section) which is connected to the upstream end portion of the suction in-duct 73. The reducer 74 is a circular hood-shaped pipe which expands toward the open end 74*a* thereof, and the open end 74*a* is installed so as to overlook the atmosphere-open section 34 from the top side. Note that, it is preferable that a commercial duct related component which is used on an expanding section or a reducing section of a duct is used for the reducer 74. The sectional surface area of the open end 74*a* of the reducer 74 is preferably 10 or more times the sectional surface area of the exhaust flow path 61 (the ejection port 62*b*) in consideration of the separation by pressure and the appropriate suction of the separated gas which are described above.

The suction in-duct 73 is formed to have a larger diameter than the exhaust flow path 61 described above, and is formed of a flexible duct made from aluminum in the same manner as the exhaust flow path 61. The suction in-duct 73 extends upward from the downward-facing reducer 74, continues horizontally, and is subsequently connected to the suction exhaust equipment S. By providing a rising portion in the suction in-duct 73 in this manner, even if a portion of the liquid which drips from the exhaust port 61*a* is unintentionally sucked into the reducer 74, the liquid adheres to the suction flow path 71 and naturally flows down (in actuality, flows down when the blower 62 is stopped).

The suction exhaust equipment S is driven separately from the printing apparatus 1 (ordinary time driving). At this time, during the driving of the mist processing device 10, the gas suction section 35 suctions the separated gas via the atmosphere-open section 34, and during the non-driving time of the mist processing device 10, the gas suction section 35 suctions the peripheral area via the atmosphere-open section 34 (factory ventilation). Note that, a configuration may be adopted in which the reducer 74 faces horizontally or faces obliquely, and the suction in-duct 73 is configured to rise from the middle.

The waste liquid collection section 36 includes the waste liquid tank 81 (a waste liquid reservoir section), a waste liquid flow path 82, the waste liquid valve 83, a drainage pan 84. The waste liquid tank 81 collects the separated liquid which is reserved in the waste liquid reservoir section 53 described above, the waste liquid flow path 82 connects the waste liquid reservoir section 53 to the waste liquid tank 81, the waste liquid valve 83 is provided such that the waste liquid flow path 82 passes therethrough, and the waste liquid tank 81 is installed on the drainage pan 84. The waste liquid flow path 82 is formed of a chemical resistant tube in the same manner as the collection flow path 43 described above. The waste liquid tank 81 is an open-type resin tank and is configured to be exchangeable (exchanged when the tank is full) by removing the flow path end of the waste liquid flow path 82 at a clasp portion.

The waste liquid valve 83 is formed of a magnetic valve or the like, for example, and is controlled to open or close by the control section 11 described above. Although detailed description will be given later, during the driving of the mist processing device 10 (during the driving of the printing apparatus 1), the waste liquid valve 83 is closed (stopped), and during the non-driving of the mist processing device 10 (the non-driving of the printing apparatus 1), the waste liquid valve 83 is opened (unstopped). The drainage pan 84 is a so-called water resistant pan and receives the liquid leakage of the waste liquid tank 81 which is generated by overflowing or the like. As described above, the drainage pan 84 receives the liquid which drips into the liquid leakage detection section 37. Note that, although omitted from the drawings, a cleaning liquid tank or the like which reserves a cleaning liquid of the ink jet head 27 is installed on the drainage pan 84.

Here, description will be given of the control method of the mist processing device 10 by the control section 11.

The control section 11 is provided with a main body control section 91, a process control section 92, and a display 93. The main body control section 91 controls the apparatus main body 2, and the process control section 92 controls the mist processing device 10. The process control section 92 includes a blower control section 95, a determination section 96, a stop control section 97, and a notification section 98. The blower control section 95 controls the blower 62, the determination section 96 determines whether or not an operation fault has occurred in the waste liquid valve 83 based on the detection results of the liquid leakage detection section 37, the stop control section 97 stops the apparatus main body 2 and the mist processing device 10 based on the determination results of the determination section 96, and the notification section 98 displays notification information on the display 93 based on the determined results of the determination section 96. The control section 11 is formed of a personal computer.

As described above, the control section 11 drives the mist processing device 10 in synchronization with the driving (the operation) of the apparatus main body 2. In the driving of the mist processing device 10, first, the waste liquid valve 83 is stopped, and subsequently, the blower 62 is driven. When the blower 62 is driven, the generated ink mist is suctioned via the mist collection section 31, and the ink mist is separated into the separated gas and the separated liquid using the gas-liquid separation section 32.

The separated gas is filtered by the filtering section 52 and exhausted to the atmosphere-open section 34 through the airflow generating section 33. The separated gas is guided to the suction exhaust equipment S via the gas suction section 35 from the atmosphere-open section 34. The separated liquid is reserved in the waste liquid reservoir section 53 of the gas-liquid separation section 32.

Meanwhile, the control section 11 sets the mist processing device 10 to non-driving (stopping) to match the non-driving (non-operating) of the apparatus main body 2. In the stopping of the mist processing device 10, first, the blower 62 is stopped, and subsequently, the waste liquid valve 83 is unstopped. When the waste liquid valve 83 is unstopped, the separated liquid of the waste liquid reservoir section 53 naturally flows down to the waste liquid tank 81 via the waste liquid flow path 82. Note that, it is preferable that, during the non-operating of the apparatus main body 2, the waste liquid valve 83 is always set to "open" (normally open).

Incidentally, in the mist processing device 10 which performs the gas-liquid separation using the cyclone 51, when an operation fault occurs in the waste liquid valve 83, various problems occur. For example, when the waste liquid valve 83 does not open (closing is maintained), the separated liquid (the UV ink) in the waste liquid reservoir section 53 spills, eventually, the spilled separated liquid is suctioned from the cyclone muffler 56 and flows out to the exhaust flow path 61 side. Meanwhile, when the waste liquid valve 83 does not close (opening is maintained), air leaks from the waste liquid flow path 82 side, and suction of the ink mist and generation of the vortex are reduced.

In the present embodiment, the separated liquid (the liquid) which flows out to the exhaust flow path 61 side is detected by the liquid leakage detection section 37 which is installed in the atmosphere-open section 34. When the liquid leakage detection section 37 detects the liquid, the control section 11 stops the apparatus main body 2 and the mist processing device 10 and performs notification of the fact that an operation fault has occurred in the waste liquid valve 83. It is preferable to perform the notification by display on the display 93 and audio. Note that, the notification may be a display indicating that a process fault has occurred in the mist processing device 10. In the operation fault of the waste liquid valve 83, when the waste liquid valve 83 does not close, it is possible to detect the operation fault using a pressure sensor which is provided inside the filter case 58.

As described above, according to the present embodiment, since the liquid which drips from the exhaust port 61*a* is detected using the liquid leakage detection section 37, when a process fault occurs in the gas-liquid separation section 32, it is possible to easily and reliably detect the process fault. More specifically, it is possible to easily and reliably detect the operation fault of the waste liquid valve 83, which is highly likely to be the cause of the process fault. Accordingly, it is possible to discover the fault location and perform a countermeasure swiftly.

In addition, essentially, it is possible to detect the liquid leakage and the like from the waste liquid tank 81 and to easily detect a process fault and an operation fault merely by moving the liquid leakage detection section 37 which is installed on the drainage pan 84 beneath the exhaust port 61*a*.

Note that, in the present embodiment, description is given of the mist processing device 10 which processes the ink mist of the UV ink; however, the type of liquid, including the type of ink, is not called into question, and the invention can be applied to the processing of a mist which is generated together with the droplet ejection of an ink jet head.

The entire disclosure of Japanese Patent Application No. 2015-025686, filed Feb. 12, 2015 is expressly incorporated by reference herein.

What is claimed is:

1. A printing apparatus provided with a functional liquid ejecting section which performs printing by ejecting a functional liquid onto a printing medium and a mist processing device which processes a functional liquid mist which is generated together with an ejection of the functional liquid, the printing apparatus comprising:

a gas-liquid separation section which separates the functional liquid mist into a separated gas and a separated liquid using a centrifugal force generated by an airflow;

an airflow generating section which is provided in an exhaust flow path which is joined to an exhaust side of the separated gas in the gas-liquid separation section and generates the airflow; and a liquid leakage detection section, which is provided beneath an exhaust port which is provided on a downstream end of the exhaust flow path, and is capable of detecting a liquid which is released from the exhaust port.

2. The printing apparatus according to claim 1, further comprising:

a waste liquid valve which is provided in a waste liquid flow path which is joined to a waste liquid side of the separated liquid in the gas-liquid separation section; and a determination section which determines whether or not an operation fault has occurred in the waste liquid valve, wherein the determination section determines that an operation fault has occurred in the waste liquid valve when the liquid leakage detection section detects the liquid.

3. The printing apparatus according to claim 2, further comprising:

a waste liquid reservoir section which is provided on a downstream end of the waste liquid flow path and reserves the separated liquid; and a drainage pan on which the waste liquid reservoir section is installed, wherein the liquid leakage detection section is installed on the drainage pan.

4. The printing apparatus according to claim 1, further comprising:

a suction flow path, which includes a suction port section which has an atmosphere-open space at an upstream end portion and faces the exhaust port, and is connected to suction exhaust equipment on a downstream side, wherein the suction port section is formed in a shape expanding toward an open end.

5. The printing apparatus according to claim 4, wherein the suction flow path extends upward in a state in which the open end of the suction port section faces downward in relation to the liquid leakage detection section.

6. The printing apparatus according to claim 1, further comprising:

a stop control section which stops printing when the liquid leakage detection section detects the liquid.

7. The printing apparatus according to claim 1, further comprising:

a notification section which performs notification indicating that a process fault has occurred in the gas-liquid separation when the liquid leakage detection section detects the liquid.

* * * * *